US005600971A

United States Patent [19]

Suk

[11] Patent Number: 5,600,971

[45] Date of Patent: Feb. 11, 1997

[54] ROOF PLATE MOUNTING ASSEMBLY

[76] Inventor: Whang K. Suk, 180-325, Bongcheon 11-Dong, Kwanak-Ku, Seoul, Rep. of Korea

[21] Appl. No.: 632,108

[22] Filed: Apr. 15, 1996

[51] Int. Cl.[6] ..... E04B 1/38

[52] U.S. Cl. ..... 52/713; 52/537; 52/508; 52/470; 52/545; 52/549

[58] Field of Search ..... 52/537, 508, 465, 52/470, 545, 549, 713

[56] References Cited

U.S. PATENT DOCUMENTS

| | | | |
|---|---|---|---|
| 2,192,719 | 3/1940 | Tapman | 52/537 X |
| 4,833,853 | 5/1989 | Deibele et al. | 52/465 X |
| 5,187,911 | 2/1993 | Cotter | 52/537 X |

*Primary Examiner*—Carl D. Friedman
*Assistant Examiner*—Timothy B. Kang
*Attorney, Agent, or Firm*—Harrison & Egbert

[57] ABSTRACT

A roof plate mounting assembly including a base member fixedly mounted to a well-known tight frame, the base member having upward extensions respectively provided at both lateral ends of the base member and locking jaws respectively inwardly bent from the upward extensions, an inverted U-shaped roof plate support member slidably coupled to the base member, the roof plate support member having wings provided at respective lower ends of the roof plate support member and upward extensions respectively extending from the wings, the upward extensions being loosely engaged in spaces respectively defined by the upward extensions and locking jaws of the base member such that the roof plate is slidable along the upward extension of the base member, a seam protecting cap extending so as to protect overlapping connecting edge portions of roof plates being coupled to each other, the seam protecting cap having downward extensions respectively downwardly extending from both lateral ends of the seam protecting cap and inward jaws provided at respective lower portions of the downward extensions, and a cap support member supporting the seam protecting cap, the cap support member extensions respectively extending from both lateral ends of the cap support member and engaging with the inward jaws of the seam protecting cap.

2 Claims, 2 Drawing Sheets

ROOF PLATE MOUNTING ASSEMBLY

BACKGROUND OF THE INVENTION

1. Field of the Invention

The present invention relates to a mounting assembly for wave-shaped metal roof plates, and more particularly to such a roof plate mounting assembly capable of effectively preventing roof plates from being distorted or being broken at their clamping holes due to their longitudinal expansion and shrinkage.

2. Description of the Prior Art

For mounting wave-shaped metal roof plates, C-beams are conventionally used. On each C-beam, a tight frame is fixedly mounted. A roof plate support member is arranged on the tight frame in the same direction as the C-beam. On the roof plate support member, one connecting edge portion, namely, the leading connecting edge portion of a roof plate is laid. The other connecting edge portion, namely, the trailing connecting edge portion of the roof plate is laid on the leading connecting edge portion of another roof plate laid on another roof plate support member to be connected with the former roof plate. To each roof plate support member, overlapping connecting edge portions of the roof plates to be connected to each other are fixedly mounted by means of bolts or set screws. In order to prevent rainwater from coming through the clamping holes formed for fixedly mounting the roof plates to each roof plate support member, those clamping holes are sealed with a waterproof liquid, waterproof paint or sealant.

Such wave-shaped metal roof plates mounted in the above-mentioned manner are subjected to variations in the temperature of the atmosphere, thereby being longitudinally and laterally expanded or shrunk. Although the lateral expansion and shrinkage of such metal roof plates do not result in unfavorable effect is on the metal roof plates, the longitudinal expansion and shrinkage are problematic because there is no means for coping therewith. Due to the longitudinal expansion and shrinkage of the roof plates, for example, bolt or screw holes formed at the roof plates may be torn. Otherwise, the roof plates may be distorted at their portions around the bolt or screw holes. This is because each roof plate support member is fixed to each tight frame, thereby disabling the associated roof plates to cope with the longitudinal expansion and shrinkage thereof.

Typically, such metal roof plates have trapezoidal corrugations each having a flat top surface. Each connecting edge portion of each roof plate is also flat because it is provided by cutting a required corrugation at its flat top surface. In practical cases, roof plates often have non-linear flat surfaces at their connecting edge portions due to their partial distortion.

Where such roof plates having incompletely flat connecting edge portions are connected to each other, it is difficult to expect a perfect contact, as in two glass sheets being overlapped, between overlapping connecting edge portions thereof throughout the length thereof. In other words, the roof plates have non-contact areas along their overlapping connecting edge portions. In this case, there is a fatal problem in the durability of roof plates because rainwater may come through the non-contact areas, thereby causing the roof plates to rust on their inner surfaces.

SUMMARY OF THE INVENTION

Therefore, an object of the invention is to provide a roof plate mounting assembly capable of achieving the mounting of roof plates while preventing the roof plates from being distorted and preventing the roof plates from breaking at their bolt or screw holes even when they expand or shrink longitudinally due to variations in the temperature of the atmosphere.

Another object of the invention is to provide a roof plate mounting assembly capable of easily, rapidly and perfectly protecting roof plates from rainwater without using any sealant such as waterproof paint.

In accordance with the present invention, a roof plate mounting assembly is provided, which comprises a roof plate fixing member and a seam protecting member. The roof plate fixing member includes a base member and a roof plate support member whereas the seam protecting member includes a seam protecting cap and a cap support member.

The roof plate support member is constructed to be loosely and slidably coupled to the base member. The roof plate support member is also fixedly mounted to roof plates, coupled to each other, by means of a bolt or screw. With such a construction, the roof plate support member slides on the base plate when the roof plates expand or shrink longitudinally due to variations in the temperature of the atmosphere. In other words, the expansion or shrinkage of the roof plates is freely carried out without any interference. Even when the roof plates expand or shrink, therefore, they do not break at their bolt holes nor become distorted at their connecting edge portions because the roof plate support member and bolt move longitudinally along the roof plates in accordance with the expansion or shrinkage of the roof plates.

In accordance with the present invention, the cap support member is fixedly mounted on the overlapping connecting edge portions of the roof plates by means of the bolt or screw. The seam protecting cap is put on the cap support member such that it is resiliently engaged with the cap support member. Once the seam protecting cap is put on, it completely covers the associated bolt hole and bolt or screw so that they may not be exposed. Accordingly, it is unnecessary to provide any sealing means even though the roof plates coupled to each other are in incomplete contact along their connecting edge portions. Furthermore, there is no possibility of erosion because the bolt or screw is prevented from coming into contact with moisture or rainwater.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
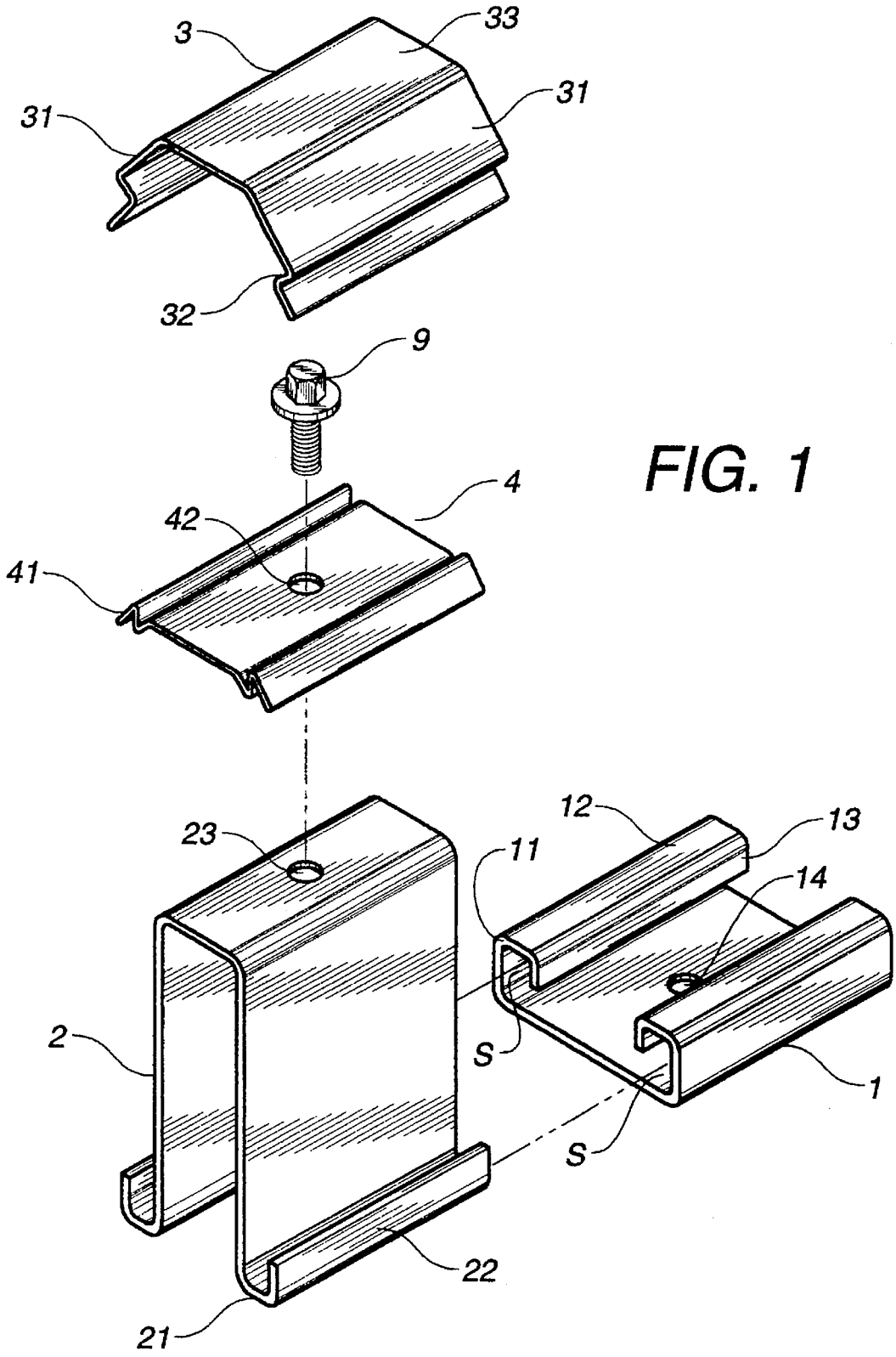
FIG. 1 is an exploded perspective view illustrating a roof plate mounting assembly in accordance with an embodiment of the present invention.
Figure 2:
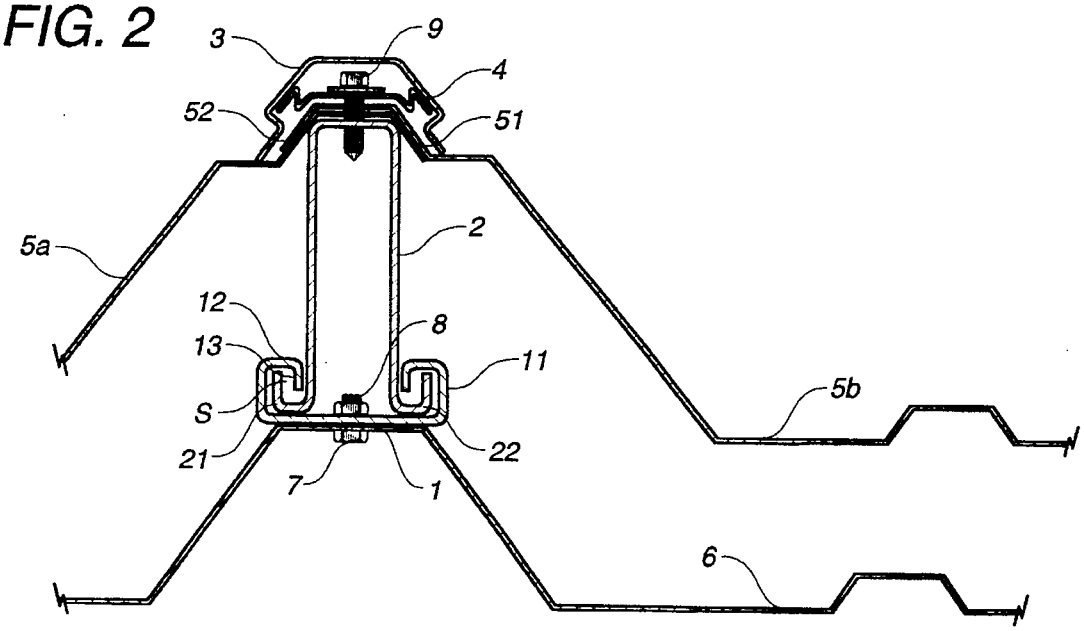
FIG. 2 is a sectional view illustrating the roof plate mounting assembly which is used to couple overlapping connecting edge portions of roof plates.

FIGS. 1 and 2 illustrate a roof plate mounting assembly in accordance with an embodiment of the present invention.

As shown in FIGS. 1 and 2, the roof plate mounting assembly includes a base member 1 provided with engaging portions respectively at its both lateral ends and a roof plate support member 2 having engaging portions respectively at its both lateral ends. The engaging portions of the roof plate support member 2 engage slidably with the engaging portions of the base member 1 so that the roof plate support member 2 can be coupled to the base member 1. Each engaging portion of the base member includes an upward extension 11 upwardly extending from each associated lateral end of the base member 1, and a locking jaw 12 inwardly bent from the upward extension 11. The base member 1 also has a bolt or screw hole 14 at its flat body portion. On the other hand, the roof plate support member 2 has an inverted U-shaped construction including a top portion and a pair of legs downwardly extending from both lateral ends of the top portion. The roof plate support member 2 is also provided at its top portion with a bolt hole 23. Each engaging portion of the roof plate support member 2 includes a wing 21 outwardly extending from the lower end of each associated leg and an upward extension 22 extending from the wing 21.

The upward extension 11 and locking jaw 12 of the base member 1 serve as a rail for guiding a longitudinal movement of the roof plate support member 2 when the roof plate support member 2 is coupled to the base member 1 while supporting the roof plate support member 2 so as to prevent it from separating upwardly from the base member 1. The upward extension 11 and locking jaw 12 define an engaging space S. This engaging space S has a size sufficient to loosely receive the corresponding upward extension 22 of the roof plate support member 2.

Preferably, each locking jaw 12 of the base member 1 has a width capable of preventing each associated upward extension 22 of the roof plate support member 2 coupled to the base member 1 from separating upwardly from the locking jaw 12 of the base member 1 even when the roof plate support member 2 moves laterally toward one side. A reinforcing rib 13 may be provided on the edge of each locking jaw 12 in order to increase the bending strength of the locking jaw 12. The reinforcing rib 13 is formed by upwardly or downwardly bending the edge of the locking jaw 12. In FIGS. 1 and 2, each reinforcing rib 13 is shown as being downwardly bent from the edge of each associated locking jaw 12.

The base member 1 may be formed by injection-molding or extruding a plastic material, or by bending a metal plate. Where the base member 1 is formed by injection-molding a plastic material, it is desirable to use a synthetic resin having a heat resistance and cold resistance. In this case, the base member 1 also has an increased thickness so that it can have a desired strength.

The roof plate support member 2 has a width at the bottom portion thereof, including the widths of both wings, slightly smaller than the width of the base member 1 so that each engaging portion of the roof plate support member 2 including wing 21 and upward extension 22 can be loosely and slidably engaged with each corresponding engaging portion of the base member 1. Each upward extension 22 of the roof plate support member 2 also has a height slightly smaller than each upward extension 11 of the base member 1 so that the slidable engagement between the base member 1 and roof plate support member 2 can be as stable as possible without being excessively loose.

The base member 1 and roof plate support member 2 may have an optional length in so far as bolt or screw holes are provided at respective span portions of the base member 1 and roof plate support member 2. They may be formed to have a desired length or a length longer than the desired length. In the latter case, each member is cut into pieces having the desired length.

The roof plate mounting assembly further includes a seam protecting cap 3 which has a pair of downward extensions 31 each formed by downwardly bending each lateral portion of the seam protecting cap 3. Each downward extension 31 is provided at its lower portion with an inward jaw 32 extending throughout the length of the seam protecting cap 3. The seam protecting cap 3 also has a top portion 33 serving as a base. It is preferred that the top portion 33 of the seam protecting cap be of an arc shape to suppress it from being distorted.

The roof plate mounting assembly also includes a cap support member 4 adapted to be fixedly mounted on a seam area where overlapping connecting edge portions of roof plates are connected to each other, so as to support the seam protecting cap 3. The cap support member 4 is provided at each of its lateral edges with a bent extension 41 which is engaged with each associated inward jaw 32 of the seam protecting cap 3 when the seam protecting cap 3 is coupled in position. In other words, each inward jaw 32 of the seam protecting cap 3 is received in a space defined beneath each associated bent extension 41 of the cap support member 4. The cap support member 4 also has at its central portion a bolt or screw hole 42 through which a bolt or screw will be inserted to fix roof plates.

The seam protecting cap 3 should be constructed to completely surround the overlapping connecting edge portions of roof plates being connected to each other. In this regard, the seam protecting cap 3 has a size sufficient to completely surround the overlapping connecting edge portions of the roof plates while having the same length of each roof plate. On the other hand, the cap support member 4 may have an optional length. Even when cap support members having a small length are arranged along the connecting edge portions of overlapping roof plates in a manner that they are spaced apart from one another, there is no problem in stably supporting the seam protecting cap 3. Accordingly, the cap support member 4 may be formed to have a desired length or a length longer than the desired length. In the latter case, the member is cut into pieces having the desired length.

FIG. 2 shows wave-shaped roof plates **5*a* and 5*b* fixedly mounted using the roof plate mounting assembly including the base member 1, roof plate support member 2, seam protecting cap 3 and cap support member 4** in accordance with the present invention.

For fixedly mounting such roof plates on a C-beam using the roof plate mounting assembly of the present invention, a plurality of spaced bolts 7 are first coupled to a tight frame 6 previously fixed to the C-beam in such a manner that it is upwardly protruded. Thereafter, base members 1 are fixedly mounted to respective threaded upper end portions of the bolts 7 by fitting the bolt hole 14 of each base member 1 around the threaded upper end portion of each bolt 7 and then threadedly coupling a nut 8 to the threaded portion of the bolt 7 while maintaining the upward extensions 11 of the base member 1 parallel to the C-beam. Roof plate support members 2 are then coupled respectively to the base members 1 by slidably inserting the upward extensions 22 of each roof plate support member 2 respectively into the spaces S defined at both lateral ends of each associated base member 1. At this state, each roof plate support member 2 is longitudinally slidable along the corresponding base member 1.

Thereafter, a plurality of bolt holes are perforated into each connecting edge portion of each roof plate in such a manner that they are aligned with respective bolt holes 23 of the roof plate support members 2. After this perforation, the leading connecting edge portion 51 of one roof plate 5*a* which has completed its mounting at its trailing connecting edge portion 52 is laid on the roof plate support members 2 such that its bolt holes are aligned with respective bolt holes 23 of the roof plate support members 2. Subsequently, the trailing connecting edge portion 52 of the other roof plate 5*b* is laid on the leading connecting edge portion 51 of the roof plate 5*a* such that its bolt holes are aligned with respective bolt holes 23 of the roof plate support members 2. Cap support members 4 are then laid on the trailing connecting edge portion 52 of the roof plate 5*b* such that their bolt holes 42 are aligned with respective bolt holes 23 of the roof plate support members 2. Bolts 9 are then threadedly coupled into the vertically aligned bolt holes, thereby fixedly mounting the overlapping connecting edge portions 51 and 52 of the roof plates 5*a* and 5*b* to the roof plate support members 2.

After completing the mounting of the roof plates, seam protecting caps 3 are coupled over the cap support members 4, respectively, by putting each seam protecting cap 3 on each associated cap support member 4 such that each inward jaw 32 of the seam protecting cap 3 engages in the space defined beneath each associated bent extension 41 of the cap support member 4. Thus, the mounting of the roof plates is completed.

The roof plates mounted as mentioned above expand or shrink longitudinally and laterally as the atmosphere varies in temperature in accordance with the season. When the roof plates expand or shrink, the roof plate support members 2 move on the associated base members 1 in the longitudinal direction of the roof plates, namely, in the longitudinal direction of the C-beam, together with the roof plates. At this time, the bolts 9 also move along with the roof plate support members 2. The cap support members 4 also slide in the associated seam protecting caps 3 along the roof plates. Thus, the roof plate support members 2 and bolts 9 move longitudinally along the roof plates, thereby preventing the roof plates from breaking at their bolt holes and from becoming distorted at their connecting edge portions. Although the seam protecting caps 3 also expand or shrink due to variations in the temperature of the atmosphere, they always keep their normal shape because they slide along the associated cap support members 4 upon their expansion or shrinkage.

Figure 3:
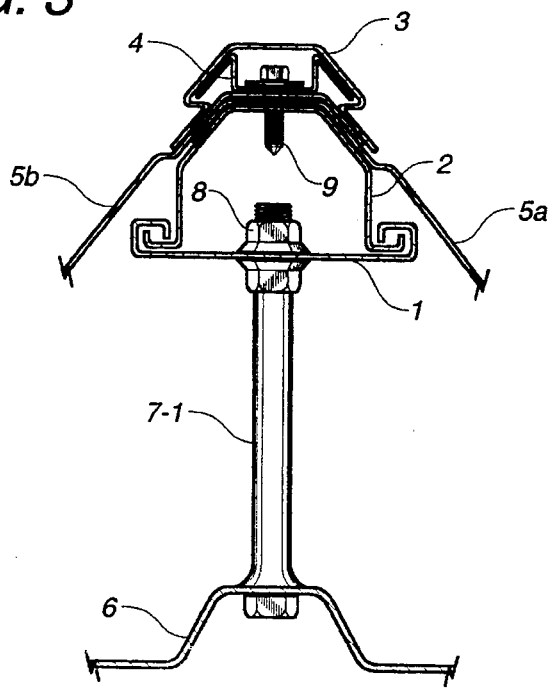
FIG. 3 is a sectional view illustrating a roof plate mounting assembly in accordance with another embodiment of the present invention, which is used to couple overlapping connecting edge portions of roof plates.

FIG. 3 illustrates a roof plate mounting assembly in accordance with another embodiment of the present invention. Although the base members 1 are directly laid on the tight frame 6 and clamped to the tight frame 6 by means of short bolts 7, and roof plate support members 2 with a large height are used in accordance with the embodiment of FIGS. 1 and 2, the embodiment of FIG. 3 uses roof plate support members with a smaller height. In accordance with the embodiment of FIG. 3, the shortage of the height is compensated by using longer bolts 7-1 adapted to fix the base members 1 to the tight frame 6.

As apparent from the above description, the roof plate mounting assembly in accordance with the present invention has a construction capable of keeping wave-shaped metal roof plates at their normal states without breaking at their bolt holes or becoming distorted at their connecting edge portions when the roof plates expand or shrink longitudinally due to variations in the temperature of the atmosphere because each roof plate support member moves longitudinally on each associated base member.

In accordance with the present invention, the overlapping connecting edge portions of roof plates can be easily, simply, and completely sealed without using any waterproof paint. This is accomplished by simply putting each seam protecting cap on each associated cap support member such that each inward jaw of the seam protecting cap engages in a space defined beneath each associated bent extension of the cap support member. With such a construction, each seam protecting cap can also be easily removed from each associated cap support member. Accordingly, it is possible to easily repair the roof plates, seam protecting caps and cap support members.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A roof plate mounting assembly comprising:

a base member fixedly mounted to a well-known tight frame, the base member having a flat body portion, upward extensions respectively upwardly extending from both lateral ends of the flat body portion, locking jaws respectively inwardly bent from the upward extensions, and a clamping hole perforated at the flat body portion;

a roof plate support member slidably coupled to the base member, the roof plate support member having a top portion, legs respectively downwardly extending from both lateral ends of the top portion, wings outwardly extending from respective lower ends of the legs, upward extensions respectively upward extending from the wings, and a clamping hole perforated at the top portion, the upward extensions being loosely engaged in spaces respectively defined by the upward extensions and locking jaws of the base member such that the roof plate is slidable along the upward extension of the base member;

a seam protecting cap extending so as to protect overlapping connecting edge portions of roof plates being coupled to each other, the seam protecting cap having a top portion, downward extensions respectively downwardly extending from both lateral ends of the top portion of the seam protecting cap, and inward jaws provided at respective lower portions of the downward extensions; and a cap support member supporting the seam protecting cap, the cap support member having a flat body portion, and extensions respectively extending from both lateral ends of the flat body portion of the cap support member, and a clamping hole perforated at the flat body portion of the cap support member, the extensions of the cap support member respectively engaging at their lower edge surfaces with the inward jaws of the seam protecting cap.

2. The roof plate mounting assembly in accordance with claim 1, wherein the seam protecting cap has a width sufficient to completely cover the overlapping connecting edge portions of the roof plates.

* * * * *